US009067118B2

(12) United States Patent
Colding-Kristensen

(10) Patent No.: US 9,067,118 B2
(45) Date of Patent: Jun. 30, 2015

(54) DEVICE FOR EJECTING BALLS

(75) Inventor: Holger Colding-Kristensen, Hals (DK)

(73) Assignee: Ball Training Machine ApS, Aalborg (DK)

( * ) Notice: Subject to any disclaimer, the term of this patent is extended or adjusted under 35 U.S.C. 154(b) by 0 days.

(21) Appl. No.: 13/980,657

(22) PCT Filed: Jan. 18, 2012

(86) PCT No.: PCT/DK2012/050019

§ 371 (c)(1),
(2), (4) Date: Oct. 23, 2013

(87) PCT Pub. No.: WO2012/097821

PCT Pub. Date: Jul. 26, 2012

(65) Prior Publication Data

US 2014/0034034 A1 Feb. 6, 2014

(30) Foreign Application Priority Data

Jan. 19, 2011 (DK) ..... 2011 70028

(51) Int. Cl.

| | |
|---|---|
| ***A63B 69/40*** | (2006.01) |
| ***F41B 3/03*** | (2006.01) |
| ***A63B 69/00*** | (2006.01) |
| ***F41B 7/00*** | (2006.01) |

(52) U.S. Cl.

CPC ..... *A63B 69/408* (2013.01); *A63B 69/002* (2013.01); *F41B 3/03* (2013.01); *A63B 69/0075* (2013.01); *A63B 2209/08* (2013.01); *F41B 7/00* (2013.01)

(58) Field of Classification Search

CPC ..... A63B 69/408; A63B 69/0075; A63B 69/002; F41B 3/03; F41B 7/00

USPC ..... 124/7, 16, 36, 81; 473/438, 446

See application file for complete search history.

(56) References Cited

U.S. PATENT DOCUMENTS

| | | | | |
|---|---|---|---|---|
| 3,128,752 | A * | 4/1964 | Andersen | 124/16 |
| 3,610,223 | A * | 10/1971 | Green | 124/16 |
| 3,659,576 | A * | 5/1972 | Eade et al. | 124/7 |
| 3,779,227 | A * | 12/1973 | Scott | 124/16 |
| 3,804,071 | A * | 4/1974 | Winrow | 124/16 |

(Continued)

FOREIGN PATENT DOCUMENTS

CN 200948344 Y 9/2007

*Primary Examiner* — Melba Bumgarner
*Assistant Examiner* — Alexander Niconovich
(74) *Attorney, Agent, or Firm* — Roberts Mlotkowski Safran & Cole, P.C.; David S. Safran

(57) ABSTRACT

An apparatus for ejecting balls in which a pretensioning arrangement includes a loading device which is displaceable between a first and a second position, first and second locking members are brought to contact each other by displacement of the loading device to a first position as a pivot arm is thereby moved to the loading position, and displacement of the loading device to a second position produces pretensioning of the pivot arm in the loading position. As a result, the pivot arm has a position in which the apparatus is safe because the pivot arm is without tension in the shooting position. Also, the pivot arm can be moved to its loading position without a simultaneous pretensioning being effected. Pretensioning is only established when the pivot arms are in the loading position and are retained by the locking arrangement. Thus, the loading arrangement and shooting power can be varied.

7 Claims, 4 Drawing Sheets

(56) References Cited

U.S. PATENT DOCUMENTS

| | | | | | |
|---|---|---|---|---|---|
| 3,878,828 | A | * | 4/1975 | Francesco | 124/16 |
| 4,122,822 | A | * | 10/1978 | Scheiwiller | 124/54 |
| 4,175,535 | A | * | 11/1979 | Diem | 124/7 |
| 4,254,755 | A | * | 3/1981 | Morgan et al. | 124/16 |
| 4,345,577 | A | * | 8/1982 | Andersson | 124/16 |
| 4,365,612 | A | * | 12/1982 | Defosse | 124/54 |
| 4,391,264 | A | * | 7/1983 | Abraham et al. | 124/50 |
| 4,511,141 | A | * | 4/1985 | Dumas | 473/419 |
| 5,415,150 | A | * | 5/1995 | Dallas | 124/50 |
| 5,465,978 | A | * | 11/1995 | Magnone et al. | 124/7 |
| 5,562,282 | A | * | 10/1996 | Stevenson | 124/7 |
| 5,911,214 | A | * | 6/1999 | Andrews | 124/16 |
| 6,050,906 | A | * | 4/2000 | Stout et al. | 473/438 |
| 6,715,478 | B1 | * | 4/2004 | Tanner | 124/16 |
| 7,066,846 | B2 | * | 6/2006 | Horkan | 473/438 |
| 7,549,415 | B2 | * | 6/2009 | Karellas | 124/16 |
| 8,286,619 | B2 | * | 10/2012 | Mihaljevic | 124/16 |
| 2006/0030434 | A1 | * | 2/2006 | Horkan | 473/438 |

* cited by examiner

DEVICE FOR EJECTING BALLS

BACKGROUND OF THE INVENTION

1. Field of the Invention

The present invention concerns an apparatus for ejecting balls including: a frame supporting a ball holder which is adapted for supporting a ball; an ejecting arrangement adapted for ejecting the ball from the ball holder; and a control unit; the ejecting arrangement including a pivot arm which is pivotable about a shaft between a loaded position and a shooting position and having an impact face spaced apart from the shaft, where the ball holder and the impact face are arranged such that the ball is hit by the impact face during the working stroke of the pivot arm in a direction from the loaded position to the shooting position, the apparatus including a locking arrangement with a first locking member connected to the frame and a second locking member connected to the pivot arm for releasable retention of the pivot arm in the loaded position, and a pre-tensioning arrangement with a torsion spring for pre-tensioning the pivot arm by pivoting the pivot arm about a pivot shaft.

2. Description of Related Art

In connection with goalkeeper training in soccer, it has appeared advantageous to use an apparatus for ejecting balls against a goalkeeper. Hereby field players that otherwise would be bound by the task of shooting against the goalkeeper are freed, reserving them for their own practice. Moreover, better precision and repeatability of the single shots against the goalkeeper are achieved such that shots can be practiced from different position with preselected direction and speed.

An apparatus using a principle known from catapults where a pivot arm is pre-tensioned by a torsion spring is known. The pre-tensioned pivot arm is released and pivots with great force against a ball placed in a ball holder. Some of the energy in the pivot arm is transmitted to the ball by impact. The ball is thereby ejected from the apparatus. The pivot arm is stopped by impact against an end stop. It is a drawback of such apparatus that a large amount of energy is transmitted to the frame of the apparatus when the pivot arm strikes the end stop. The energy is transmitted to the frame whereby the apparatus is set into motion and the energy is typically absorbed by friction against the ground. It is therefore necessary to fasten the apparatus to the ground in order to avoid that the apparatus moves between the shots as otherwise it will be impossible to achieve the desired precision and repeatability between successive shots. However, it is difficult to fasten the apparatus on a soccer field and particularly on the tournament field of a club as a large number of fastening members are required, e.g., strong plugs that will leave unacceptably large damage on the ground. Moreover, the apparatus will be less mobile whereby it becomes time consuming and difficult to practice shots from different positions.

A disadvantage of an apparatus of the above type is that the pre-tensioned spring constitutes a safety risk during maintenance of the apparatus as inadvertent release of the spring may cause injury to service personnel. Furthermore, the pre-tensioning of the spring itself during mounting is associated with great danger to the personnel.

U.S. Pat. No. 5,911,214 discloses an apparatus for ejecting balls where the apparatus is provided with a shock absorber connected between the frame and the pivot arm for absorbing the energy released during braking of the pivot arm. The shock absorber includes a piston mounted in a cylindrical housing. The wall of the housing has a series of perforations distributed along the housing and dimensioned so that the shock absorber can absorb and discharge, respectively, air through the perforations, thereby gradually braking the pivot arm when it approaches the end of its stroke. This is a relatively complicated way of braking the pivot arm. Moreover, packings between the piston and the housing have to be replaced from time to time.

Furthermore, an apparatus of the type mentioned in the introduction is known from U.S. Pat. No. 7,066,846 B2. Similar to other prior art apparatus, in this apparatus, there will occur a simultaneous pre-tensioning during the pivoting of the pivot arm to its loaded position such that the full pre-tensioning is determined by the returning of the pivot arm from the shooting position to the loaded position. During the return pivoting to the loaded position, the pre-tensioning is built up to the maximum pre-tensioning which is attained in the loaded position. This requires a great power for return pivoting and entails a limitation in the possibility of varying the shooting power.

SUMMARY OF THE INVENTION

It is the object of the invention to provide an apparatus for ejection of balls where the above safety risks are avoided.

According to the present invention, this is achieved by an apparatus of the type mentioned in the introduction which is peculiar in that the pre-tensioning arrangement includes a loading means which is displaceable between a first and a second position, that first and the second locking members are brought to contact each other by displacement of the loading means to the first position as the pivot arm is thereby moved to the loaded position, and that the displacement of the loading means to the second position is establishing a pre-tensioning of the retained pivot arm in the loaded position.

Hereby is achieved that the pivot arm has a position where the apparatus is safe as the pre-tensioning arrangement is adapted such that the pivot arm is without tension in the shooting position. Also, the pivot arm can be moved to its loaded position without a simultaneous pre-tensioning being produced. The pre-tensioning is only established when the pivot arms are situated in the loaded position and are retained by the locking arrangement. In this situation, the second position of the loading means can be varied, and thereby the shooting power can be varied without being limited to the angle through which the pivot arm is moved by returning from the shooting position to loaded position.

By adjusting the pivot arm in the shooting position, a fitter can safely perform maintenance of the apparatus without risk of stored energy being released inadvertently. Furthermore, it is easy and simple to adjust the control unit to provide different shooting power by controlling the travel of the loading means between the first and second positions.

The locking arrangement can releasably retain the pivot arm in the loaded position in a condition where the torsion spring is pre-tensioned or without tension. This is achieved in that the loading means by displacement from its first position is adapted to pivot the pivot arm to the loaded position, and by displacement to its second position adapted to pre-tension the torsion spring in a condition where the locking members of the locking arrangement are engaged and retain the pivot arm.

The ball holder is adapted such that the ball is supported without interfering with the path of the ball out of the apparatus and without coming into the path of the pivot arm. For example, the part of the ball holder which is in contact with the ball can be two horizontal rails, one at each side of the pivot arm, such that the pivot arm can pass between the rails and such that no part of the rails are in the way of the ball after being hit.

The pivot arm in the ejecting arrangement can be pivoted towards the loaded position manually or automatically.

The apparatus is prepared for shooting by placing the pivot arm in the loaded position. Then, the locking arrangement is activated such that the pivot arm is securely retained in the loaded position. A ball is placed in the ball holder and the pre-tensioning arrangement is activated whereby the pivot arm is pre-tensioned. By releasing the locking arrangement, the pivot arm is released which pivots towards the shooting position while relaxing the pivot arm. Then, the apparatus can be made ready for shooting again.

The pre-tensioning arrangement can be adjustable such that the pre-tensioning of the pivot arm is variable. The energy transferred to the ball may thereby be varied so that it will be possible to allow for balls with different weights or to increase/reduce the shooting distance.

The impact face can be part of the pivot arm or a loose element which is fastened to the pivot arm, possibly with a releasable fastening. In the latter embodiment, it will be possible replace the impact surface which may be advantageous as the design of the impact face has influence on rotation of the ball, i.e., spinning, among others.

The pre-tensioning arrangement may, e.g., contain an energy storage element, such that energy is stored, pre-tensioning the pivot arm in the loaded position. When the pivot arm is released from the locking arrangement, the energy is released and converted to movement of the pivot arm so that the latter is relaxed when the shooting position is reached. The kinetic energy at the time where the pivot arm is in the shooting position is transmitted to the ball.

Examples of energy storage elements can be a pressure cylinder loaded with a gas, a spring, an elastic material. Common to the mentioned examples is that they can store an amount of energy that pre-tensions the pivot arm, that they can release the energy when the pivot arm is released and that they are offloaded so that the pivot arm is relaxed in the shooting position.

The amount of energy available for transmission to the ball depends on how much energy is stored in the pre-tensioning arrangement. The shooting power and thereby the shooting distance becomes controllable hereby.

According to a further embodiment, the apparatus according to the invention is peculiar in that the first locking member is an electromagnet and that the second locking member is formed of a magnetiseable material interacting with the first locking member, where the first and second locking members are optionally placed on the frame and the pivot arm, respectively.

Mechanically speaking, this is a particularly simple and reliable way of establishing the locking arrangement. There are no movable parts which can be exposed to wear or mechanical failure. Activating the locking arrangement occurs by bringing the first and second locking members in immediate vicinity of each other whereafter the electromagnet is energized so that it attracts the second locking member. Release occurs by interrupting the power supply to the electromagnet.

According to a further embodiment, the apparatus according to the invention is peculiar in that the torsion spring has a first and a second end, that the first end of the torsion spring is connected with the pivot arm and that the second end of the torsion spring is connected with the loading means.

The torsion spring is adapted such that it has a center axis coaxial with the shaft for the pivot arm. When the loading means is displaced between the first and second positions, the pivot arm is moved via the connection of the two elements through the torsion spring such that the loading means can pivot the pivot arm from the shooting position to the loaded position. The pivot arm is then retained in the shooting position by the locking arrangement. By displacing the loading means back towards the initial position in direction against the shooting position of the pivot arm, the torsion spring is twisted such that energy is loaded into it, thereby pre-tensioning the pivot arm. The pivot arm can be relaxed either by releasing the locking arrangement or by displacing the loading means back to the position at which the pivot arm is in the loaded position.

The twisting of the torsion spring under the free movement of the pivot arm is limited. It is influenced by the weight of the pivot arm which gives a small contribution compared with the weight with which the loading means acts on the torsion spring when the pivot arm is pre-tensioned.

The torsion spring is dimensioned such that the pre-tensioning can be regulated within desired ranges determined by the properties of the pivot arm, the weight and dimension of the ball, and the desired shooting distance.

The loading means can be a rotary actuator.

By controlling the displacement of the loading means during pre-tensioning of the pivot arm and thereby the amount of energy stored in the torsion spring, the shooting distance can be adjusted.

According to a further embodiment, the apparatus according to the invention is peculiar in that the loading means includes a linear actuator and a pre-tensioning arm, where the linear actuator by its first end is connected with the frame and by its second end with the pre-tensioning arm, where the pre-tensioning arm is pivotable about the shaft and where the pre-tensioning arm is connected with the linear actuator and the second end of the torsion spring.

Hereby is achieved a simple way of indicating the loading means since linear actuators are simple to make.

The pre-tensioning arm converts the linear movement from the actuator to rotation/twisting of the torsion spring.

By controlling the displacement of the loading means during pre-tensioning of the pivot arm and thereby the amount of energy stored in the torsion spring, the shooting distance can be adjusted.

According to a further embodiment, the apparatus according to the invention is peculiar in that the pre-tensioning arrangement includes an additional loading means and an additional torsion spring.

The pre-tensioning arrangement can hereby be designed such that the action of force on the pivot arm becomes symmetric as the pre-tensioning arrangement can be designed with a torsion spring and a loading means at each side of the pivot arm.

According to a further embodiment, the apparatus according to the invention is peculiar in that the ball holder includes a displacing mechanism for lateral displacement of the ball holder, and that the impact face is curved in a plane perpendicular to the path of the pivot arm.

Hereby is achieved that the ball can be spun. A center plane through the ball will be offset from the path of the pivot arm. Since the impact face is curved, it will strike the ball at a position which is offset from the center plane and with a component which besides giving the ball a forward directed speed will provide the ball with a rotation. The path of the ball will curve which in the professional terms is called a "spinning" ball.

The displacement mechanism may advantageously displace the center plane for the ball at one or the other side of the path of the pivot arm. This provides possibility of spinning the ball in either direction.

A goalkeeper may have difficulty in judging the path of a spinning ball. Spinning balls are therefore an important part of the goalkeeper practice in order to train this ability.

The curve of the impact face may, e.g., simulate the wrist of a player as the player is using this in order to provide the spinning.

According to a further embodiment, the apparatus according to the invention is peculiar in that the ball holder includes a displacing mechanism for vertical displacement of the ball holder, and that the impact face is curved in a plane in parallel with the path of the pivot arm.

Hereby is achieved that the height of the path of the ball can be adjusted. When the ball holder is lowered, the impact face strikes higher, whereby the ball is imparted a lower path compared with elevating the ball holder, whereby the ball is imparted a higher path.

The impact face can be flat, or more advantageously, curving. The curvature can be adapted such that the force from the impact face is directed through the center of the ball. Hereby, over- or underspinning of the ball is avoided. Alternatively, the curvature can be adapted such that the ball can be overspun or underspun.

According to a further embodiment, the apparatus according to the invention is peculiar in that the frame is supported by a chassis with wheels.

Hereby is achieved that the apparatus becomes mobile and may easily be moved between various shooting positions. The wheels can be air-filled so that they are capable of absorbing vibrations transmitted from the frame to the ground, or from the ground to the frame.

According to a further embodiment, the apparatus according to the invention is peculiar in that the apparatus includes a dispensing arrangement for dispensing balls to the ball holder.

Hereby is achieved that the apparatus becomes safe to operate as the user does not need to approach the ball holder in order to place a new ball between the shots. Hereby is avoided that the pivot arm is pre-tensioned by error and released while the user is at a position in front of the apparatus.

Furthermore, this will provide for remotely controlling or automating the operation of the apparatus.

The apparatus described above may also be used for other sports than soccer where a ball is to be ejected with exact direction and speed.

In addition to goalkeeper practice, the apparatus can also be used for training field players in receiving crosses from the apparatus.

The invention will now be explained more closely with reference to the accompanying drawings.

DETAILED DESCRIPTION OF THE INVENTION

Figure 1:
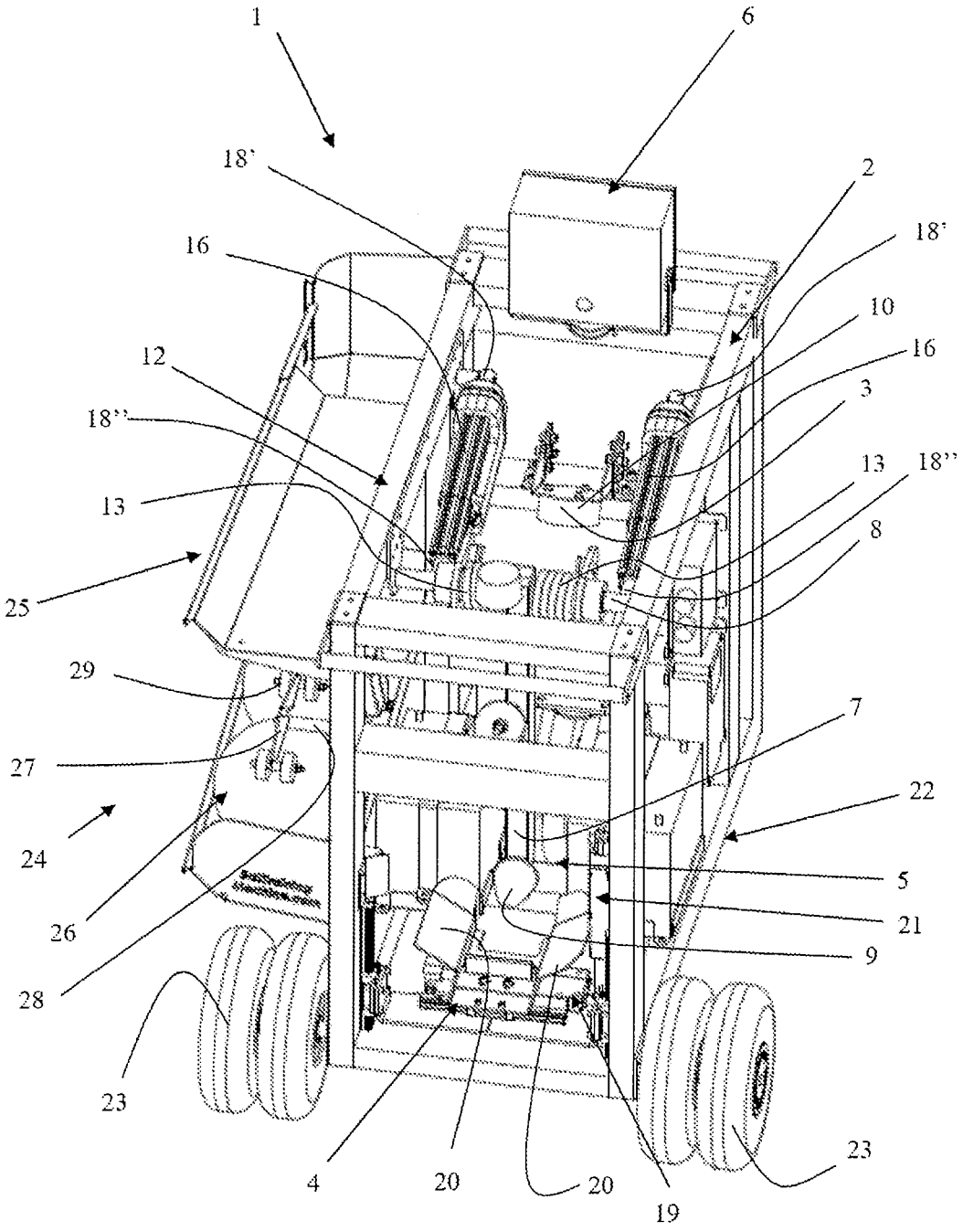
FIG. 1 shows a first isometric illustration of the apparatus according to the invention.
Figure 2:
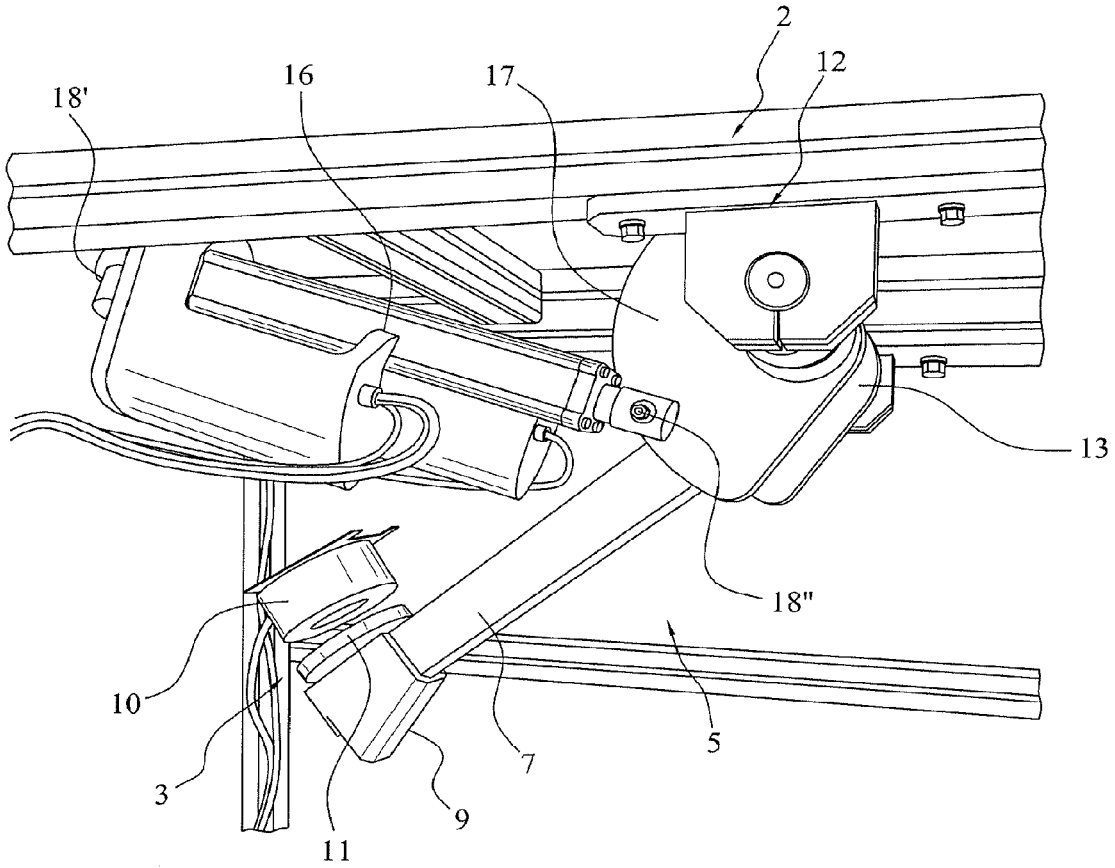
FIG. 2 shows an illustration of the pivot arm, the locking arrangement and the pre-tensioning arrangement as seen from the side.
Figure 3:
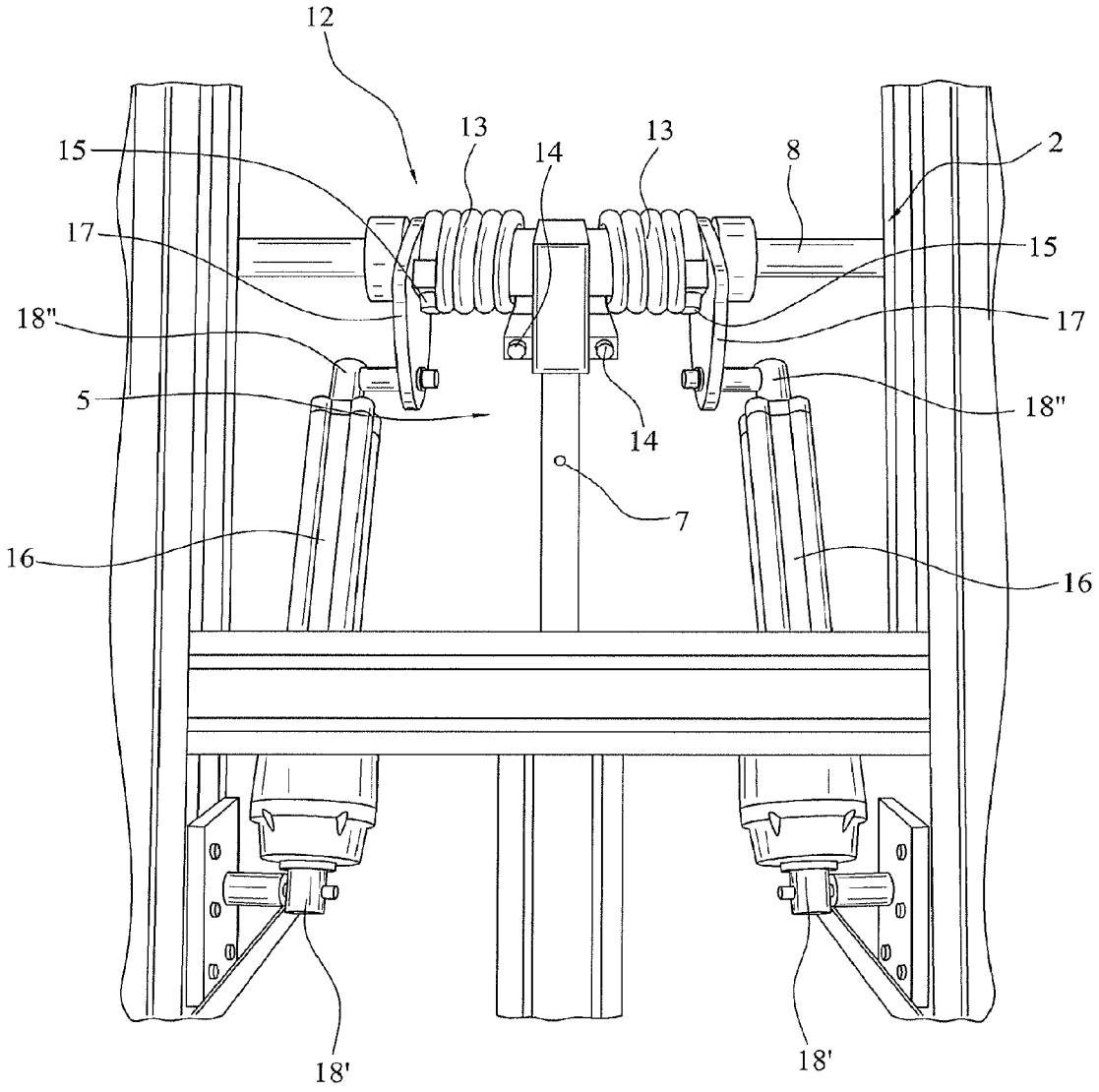
FIG. 3 shows an illustration of the pivot arm and the pre-tensioning arrangement as seen from the side.
Figure 4:
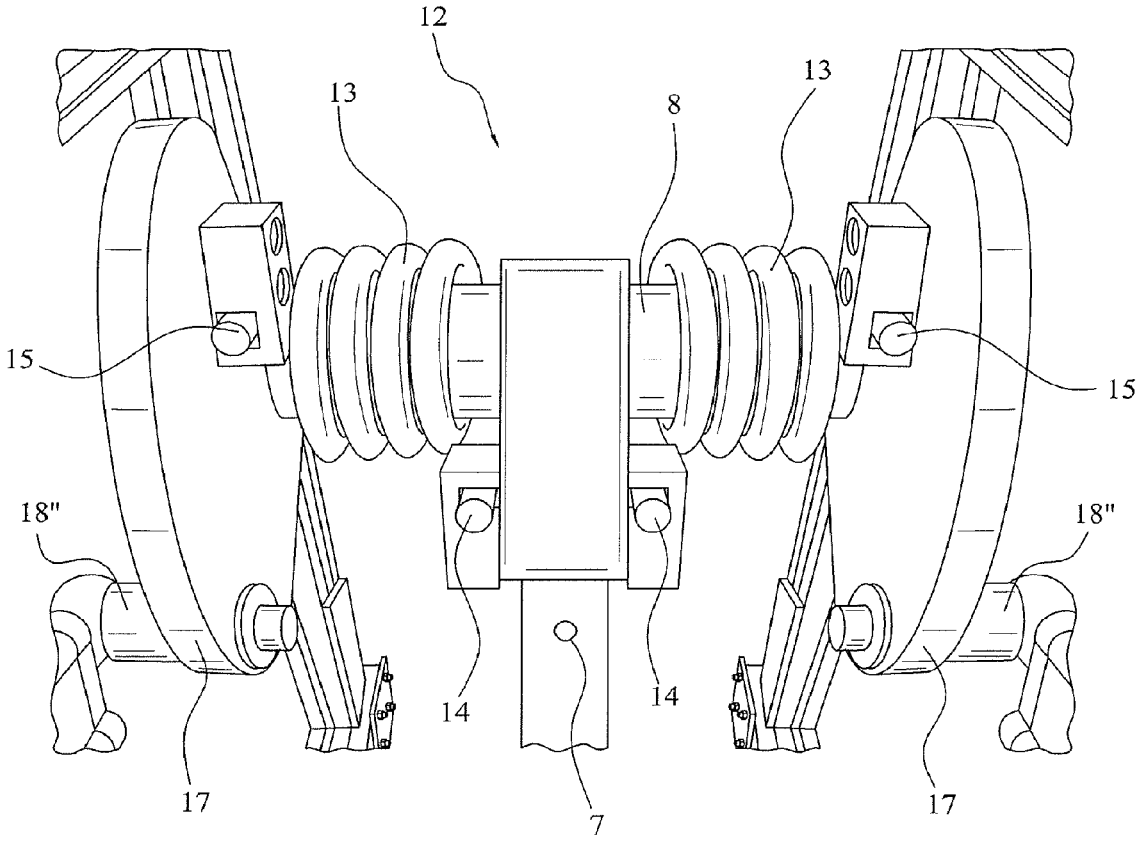
FIG. 4 shows a close-up view of the area around the shaft.

FIG. 1 shows an apparatus 1 according to the invention and FIGS. 2-4 show various details of the apparatus in FIG. 1.

In the explanation of the figures, identical or corresponding elements will be provided with the same designations in different Figures. Therefore, no explanation of all details will be given in connection with each figure/embodiment.

FIG. 1 shows an embodiment of an apparatus 1 for ejecting balls. The apparatus 1 includes a frame 2 supporting a ball holder 4 adapted to support a ball, an ejecting arrangement 5 adapted for ejecting the ball from the ball holder 4 and a control unit 6.

The ejecting arrangement 5 includes a spring-biased pivot arm 7 which is pivotable about a shaft 8 and which has an impact surface 9 at a distance from the shaft 8. The ball holder 4 and the impact face 9 are arranged such that the ball 2 is hit by the impact face 9 during the working stroke of the pivot arm in a direction from the loaded position to the shooting position.

The apparatus 1 includes a locking arrangement 3 for releasable retention of the pivot arm 7 in the loaded position.

In the illustrated embodiment, the locking arrangement 3 is formed by the first locking member 10, which is an electromagnet, and a second locking member 11 formed of a magnetiseable material and which interacts with the first locking member 10. The first locking member 10 is provided on the frame 2 and the second locking member 11 is provided on the pivot arm 7.

The apparatus 1 further includes a pre-tensioning arrangement 12 for pre-tensioning the pivot arm 7 in the loaded position, and where the pre-tensioning arrangement 12 is adapted for relaxing the pivot arm 7 in the shooting position.

In the illustrated embodiment, the pre-tensioning arrangement 12 includes a torsion spring 13 with a first 14 and a second end 15 (see, FIG. 4), and a loading means 16 which is displaceable between a first and a second position. The first end 14 of the torsion spring is connected with the pivot arm 7, and the second end 15 of the torsion spring is connected with the loading means 16.

The locking arrangement 3 can releasably retain the pivot arm 7 in the loaded position in a condition where the torsion spring 13 is pre-tensioned or slackened as the loading means 16, by displacement to its first position, is adapted to pivot the pivot arm 7 to the loaded position, and by displacement to its second position is adapted to tension the torsion spring.

In the illustrated embodiment, the loading means 16 includes a linear actuator and a pre-tensioning arm 17 (see, FIG. 2). The linear actuator is connected with the frame 2 by its first end 18'. The pre-tensioning arm 17 is disposed between one end 15 of the torsion spring to which it is connected and the second end 18" of the linear actuator to which it is also connected.

In the illustrated embodiment, the pre-tensioning arrangement 12 has two loading means 16 and two torsion springs 13.

The ball holder 4 includes two rails 20 that support the ball.

The ball holder 4 includes a displacement mechanism 19 for lateral displacement of the ball holder 4.

The impact face 9 can be curved in a plane perpendicular to the path of the pivot arm so that it becomes possible to spin the ball about a vertical axis when the ball holder 4 is displaced in a horizontal direction from the original position.

The ball holder 4 further includes a displacement mechanism 21 for vertical displacement of the ball holder 4.

The impact face 9 is curved in a plane in parallel with the path of the pivot arm so that it becomes possible to spin the balls 2 about a horizontal axis when the ball holder 4 is displaced in vertical direction from the original position.

In the illustrated embodiment, the frame 3 is supported on a chassis 22 with wheels 23.

The apparatus 1 includes a dispensing arrangement 24 for dispensing balls to the ball holder 4.

The dispensing arrangement 24 includes a rail system 25 for storing and conveying balls.

The dispensing arrangement 24 further includes a dispenser 26 for dispensing balls to the ball holder 4. The dispenser 26 includes a tilting arm 27 which is rotatable about a shaft 28. The tilting arm 27 is arranged such that only one ball at a time gets access to the ball holder 4. The tilting arm 27 is provided with an arrangement of rollers 29 that lowers the friction between the tilting arm 27 and the balls. When the tilting arm 27 is tilted in a counterclockwise direction it opens access for one ball while preventing further balls from rolling forward. The ball rolls down on the ball holder 4 from the rail system 25 under the action of gravity. The tilting arm 27 is then tilted in a clockwise direction after which a new ball can roll forward, but not so far that it does not roll down upon the ball holder 4 due to the design and position of the tilting arm.

What is claimed is:

1. An apparatus for ejecting balls including:

a frame supporting a ball holder which is adapted for supporting a ball;

an ejecting arrangement adapted for ejecting the ball from the ball holder; and a control unit;

wherein the ejecting arrangement includes a pivot atm which is pivotable about a shaft between a loading position and a shooting position and having an impact face spaced apart from the shaft, wherein the ball holder and the impact face are arranged such that the ball is hit by the impact face during a working stroke of the pivot arm in a direction from the loading position to the shooting position, the apparatus further comprising:

a locking arrangement with a first locking member connected to the frame and a second locking member connected to the pivot arm for releasable retention of the pivot arm in the loading position, and a pretensioning arrangement with a torsional spring for pretensioning the pivot arm by pivoting the pivot arm about a pivot shaft, wherein the torsional spring has a first end and a second end, wherein the first end of the torsional spring is connected with the pivot arm, wherein the pretensioning arrangement includes a loading means which is displaceable between a first and a second position, wherein the second end of the torsional spring is connected with the loading means, wherein the loading means includes a linear actuator and a pretensioning arm, where the linear actuator is connected by a first end with the frame and by a second end with the pretensioning arm, wherein the pretensioning arm is pivotable about the shaft, wherein the pretensioning arm is connected with the linear actuator and the second end of the torsional spring, wherein the first and the second locking members are brought to contact each other by displacement of the loading means to the first position as the pivot aim is thereby moved to the loading position without pretensioning of the pivot arm, and wherein the displacement of the loading means to the second position is establishing a pretensioning of the retained pivot arm in the loading position.

2. Apparatus according to claim 1, wherein the first locking member is an electromagnet and wherein the second locking member is formed of a magnetizable material interacting with the first locking member, where the first and second locking members are optionally placed on the frame and the pivot arm, respectively.

3. Apparatus according to claim 1, wherein the pretensioning arrangement includes an additional loading means and an additional torsional spring.

4. Apparatus according to claim 1, wherein the ball holder includes a displacing mechanism for lateral displacement of the ball holder, and wherein the impact face is curved in a plane perpendicular to a path of the pivot arm.

5. Apparatus according to claim 1, wherein the ball holder includes a displacing mechanism for vertical displacement of the ball holder, and wherein the impact face is curved in a plane in parallel with a path of the pivot atm.

6. Apparatus according to claim 1, wherein the frame is supported by a chassis provided with wheels.

7. Apparatus according to claim 1, wherein the apparatus includes a dispensing arrangement for dispensing balls to the ball holder.

* * * * *